US005133683A

United States Patent [19]

Dorfman

[11] Patent Number: 5,133,683

[45] Date of Patent: Jul. 28, 1992

[54] TOY INCLUDING A DISSOLVABLE OUTER PACKAGE

[76] Inventor: Alan Dorfman, 65 Gregory Pl., Richboro, Pa. 18954

[21] Appl. No.: 776,912

[22] Filed: Oct. 15, 1991

[51] Int. Cl.[5] ..... A63H 3/00; A63H 33/00; A63H 23/00; B65D 85/84

[52] U.S. Cl. ..... 446/73; 446/5; 446/153; 446/385; 428/34.3; 220/DIG. 30; 206/524.7

[58] Field of Search ..... 428/34.3; 206/524.7; 220/DIG. 30; 229/3.5 R; 446/5, 73, 72, 71, 74, 76, 153, 268, 385, 386

[56] References Cited

U.S. PATENT DOCUMENTS

| | | | |
|---|---|---|---|
| 2,560,649 | 7/1951 | Hornaday | 206/524.7 X |
| 2,700,461 | 1/1955 | Smith | 206/524.7 X |
| 3,279,511 | 10/1966 | Griffin, Jr. | 220/DIG. 30 X |
| 3,431,166 | 3/1969 | Mizutani et al. | 162/135 |
| 3,680,250 | 8/1972 | Hetrick | 220/DIG. 30 X |
| 3,762,454 | 10/1973 | Wilkins, Jr. | 220/DIG. 30 X |
| 3,790,067 | 2/1974 | Scheier | 220/DIG. 30 |
| 4,725,465 | 2/1988 | Lastovich | 428/34.3 |
| 4,806,261 | 2/1989 | Ciallella et al. | 252/90 |
| 4,881,915 | 11/1989 | Liaw | 446/153 |
| 4,954,114 | 9/1990 | Kawashima | 446/268 X |
| 4,964,831 | 10/1990 | Wolff | 446/268 X |
| 5,032,102 | 7/1991 | Davidson et al. | 446/385 X |

*Primary Examiner*—Robert A. Hafer
*Assistant Examiner*—D. Neal Muir
*Attorney, Agent, or Firm*—Caesar, Rivise, Bernstein, Cohen & Pokotilow

[57] ABSTRACT

A toy whose entertainment value is altered when placed in water includes an outer package dissolvable in water which has an inner, sealed compartment to hide at least one novelty item therein. The outer package is comprised of a water soluble material which is sufficiently opaque to preclude visual inspection of any item disposed within the compartment, and in the preferred embodiment, is comprised of two sheets of such a material bonded together about their peripheral edge by a water soluble binding agent. The package has an outer peripheral edge or silhouette, generally corresponds in shape to the object, character, animal, animate or inanimate, etc., which is depicted on either or both exterior surfaces of the package. The novelty item(s) held within the compartment are made from a material, such as plastic, metal, etc., which is non-expandable when the package is placed in water. In addition, the novelty item(s) have their own independent entertainment value apart from any article outside of the compartment and include such items as a key chain, toy boat, die, etc.

21 Claims, 2 Drawing Sheets

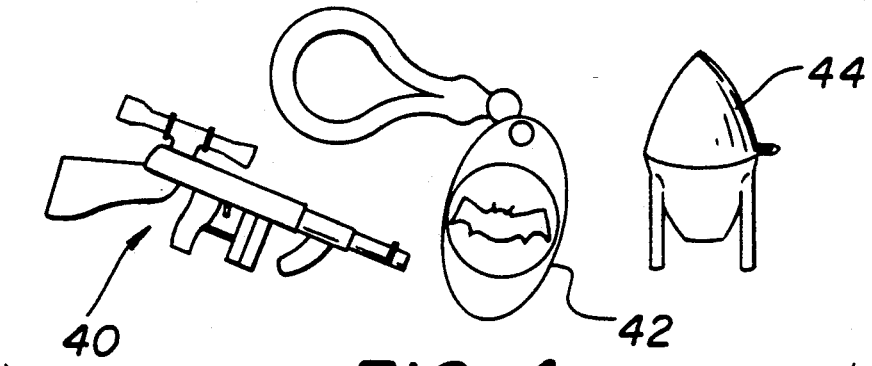
FIG. 4
FIG. 5
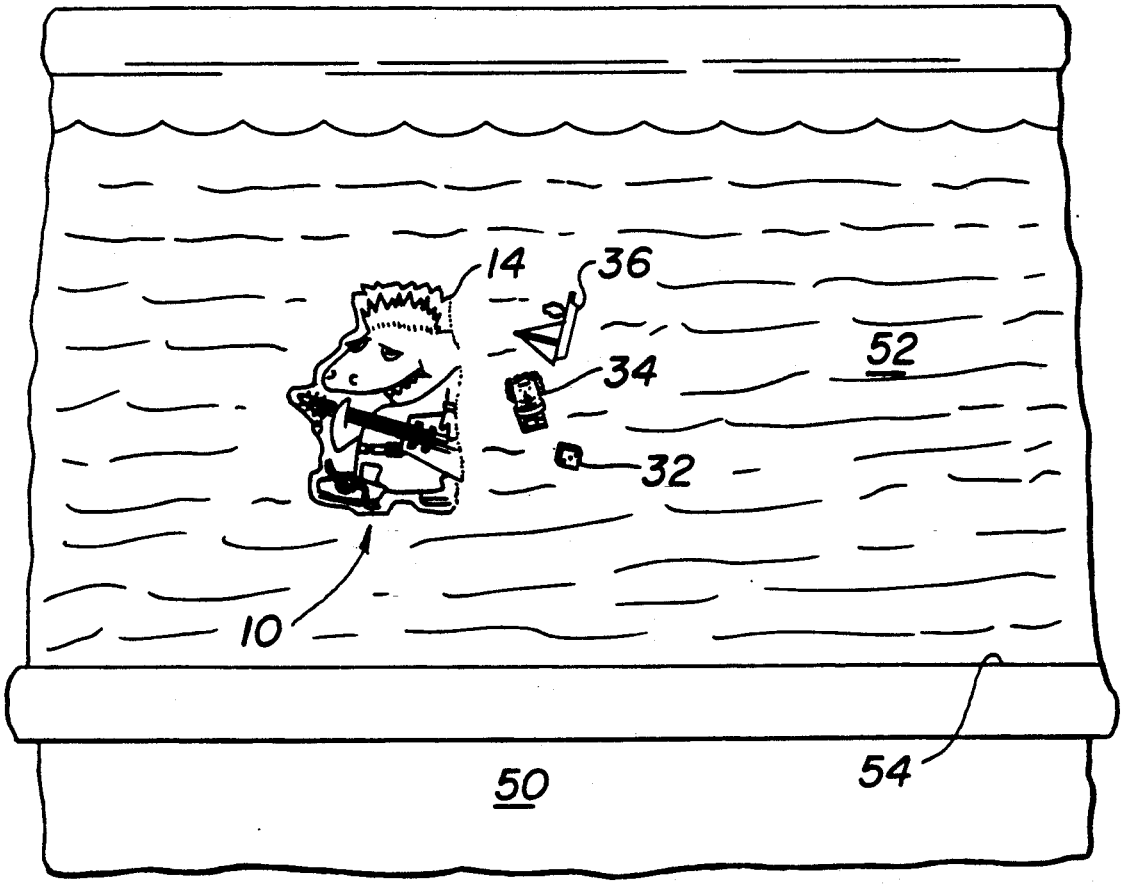

TOY INCLUDING A DISSOLVABLE OUTER PACKAGE

BACKGROUND OF THE INVENTION

Toys have been around for centuries in a wide variety of ever evolving forms developed with new concepts and technologies. The novelty of toys enables children and adults to enjoy countless hours of pleasure by utilizing their imagination in combination with the characteristics of the toy. Children also derive pleasure from playing with toys or objects which have as an element of surprise, hidden or "mystery" components which are new to the child or not entirely understood. Magicians have almost always relied upon the element of surprise to provide entertainment to audiences world wide.

Manufacturers of consumable products, such as the caramel coated popcorn sold under the trademark "CRACKER JACK", also rely on the element of surprise to provide entertainment and will "hide" an inexpensive toy surprise inside a box containing the product, as an enticement to purchase the product to discover the identity of the hidden surprise.

Numerous toys are used in conjunction with or rely on water to provide some or all of their entertainment value, e.g., boats, floats, beach balls, etc. In addition, other toys have been developed which utilize the combination of mystery in conjunction with water.

At least one toy manufacturer, i.e., MATTEL CO., has provided a toy which utilizes a material which dissolves when placed in water to expose another object contained within the material. One such toy is the unisex baby doll sold under the trade mark MATTEL'S NURSERY BABY. This doll wears a swaddling robe which, when removed and placed in water, reveals a plastic pouch containing a card identifying whether the doll is male or female and an article of doll clothing consistent with the gender of the doll and intended to be worn by the doll.

Novelty item manufacturers as well, have developed products utilizing a gelatin or other type of capsule, similar to a pharmaceutical capsule, containing therein an object, such as an animal, etc., made of a sponge-like, compressible material which is released when the capsule dissolves in water.

The concept of providing a dissolvable package or container is also well known in other areas, such as for dispensing dishwashing or laundry detergent contained within a dissolvable packet. One such dissolvable article is disclosed in U.S. Pat. No. 4,806,216, the entire disclosure of which is incorporated by reference herein. The dissolvable material employed in that detergent packet is sold by Gilbreth International Corporation, Bensalem Pa. under the trademark DISSOLVO, Water Soluble Paper, DP 45LC. Such material dissolves very quickly in water (the cellulosic or wood fibers may not actually dissolve but they break up and are separated into such small fibers that they seem to dissolve). To make the DISSOLVO water soluble paper, Gilbreth utilizes paper made by Mishima Seishi, Ltd., as disclosed in U.S. Pat. No. 3,431,155, assigned to Mishima Seishi, Ltd., the entire disclosure of which is incorporated by reference herein.

The components of the dissolvable paper may be those described in the U.S. Pat. No. 3,431,155 patent insofar as the cellulosic materials are concerned. The cellulose fibers, wood pulp or wood fibers (the terms are used interchangeably) are processable on standard paper making equipment and may be made into almost any type of packet, paper, carton, etc.

A need exists for an improved toy having an enhanced entertainment value, and it is the need for such a toy that the present invention relates.

OBJECTS OF THE INVENTION

Accordingly, it is a general object of this invention to provide a toy having enhanced entertainment value.

It is a more specific object of this invention to provide a toy having its entertainment value altered when placed in water.

It is yet another object of the present invention to provide a toy having a first entertainment value as purchased and a different entertainment value when placed in water.

It is still yet another object of the present invention to provide a toy which as purchased, has entertainment value in its visual appearance, and then a different entertainment value resulting from the disappearance or destruction of that visual appearance.

SUMMARY OF THE INVENTION

A toy whose entertainment value is altered when placed in water includes an outer package dissolvable in water which has an inner, sealed compartment to hide at least one novelty item therein. The outer package is comprised of a water soluble material which is sufficiently opaque to preclude visual inspection of any item disposed within the compartment, and in the preferred embodiment, is comprised of two sheets of such a material bonded together about their peripheral edge by a suitable binding agent, such as one made of a water soluble material. The package has an outer peripheral edge or silhouette, generally corresponds in shape to the object, character, animal, animate or inanimate, etc., which is depicted on either or both exterior surfaces of the package. The novelty item(s) held within the compartment are made from a material, such as plastic, metal, etc., which is non-expandable when the package is placed in water. In addition, the novelty item(s) preferably have their own independent entertainment value and/or use, apart from any article outside of the compartment and include such items as a key chain, toy boat, whistle, etc.

DESCRIPTION OF THE DRAWINGS

Other objects and many attendant features of this invention will become readily appreciated as the same becomes better understood by reference to the following detailed description when considered in connection with the accompanying drawings wherein:

FIG. 4 is depiction of exemplary novelty items which can be included in the inner compartment of the present invention, such as a toy rifle, a key chain with emblem and a toy rocket; and FIG. 5 is a fragmentary elevational view of a container of water in which has been placed the toy of FIG. 1, showing the package partially dissolved so as to release a plurality of novelty items contained within the package component of the toy.

DETAILED DESCRIPTION OF THE PREFERRED EMBODIMENT

Figure 1:
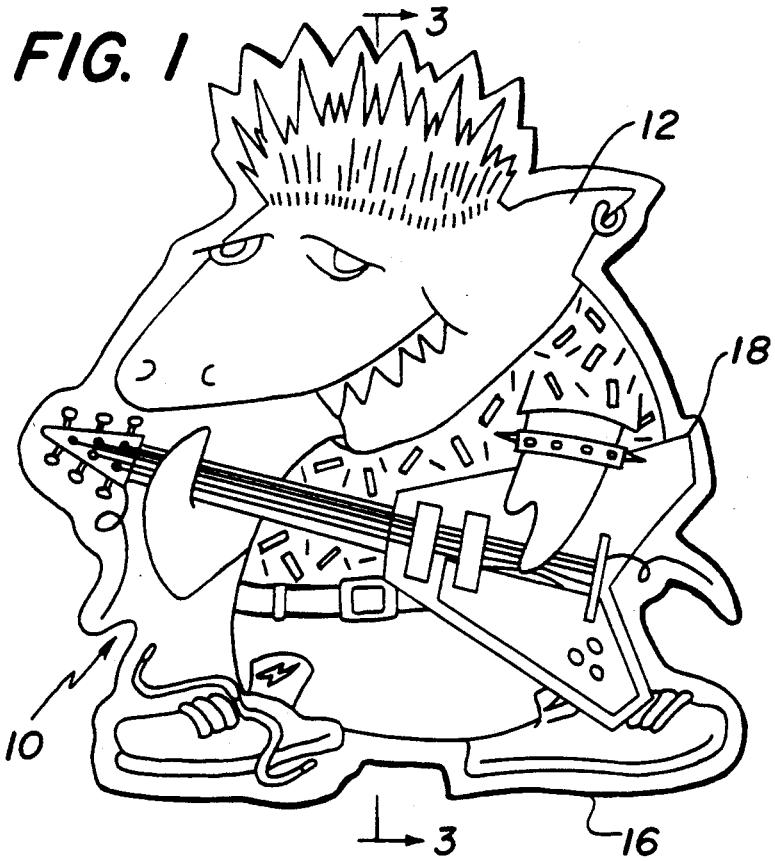
FIG. 1 is a front view of the toy of the present invention in the form of a package having a silhouette and visual image of a fantasy character holding a guitar.

Referring now to various figures of the drawings where like reference numerals refer to like parts, there is shown at 10 in FIG. 1, a toy constructed in accordance with this invention with a visual image of an imaginary character 12 depicted thereon. The entertainment value of this toy is altered when a portion of the package component of the toy is dissolved in water, as is described in detail hereinafter.

Figure 2:
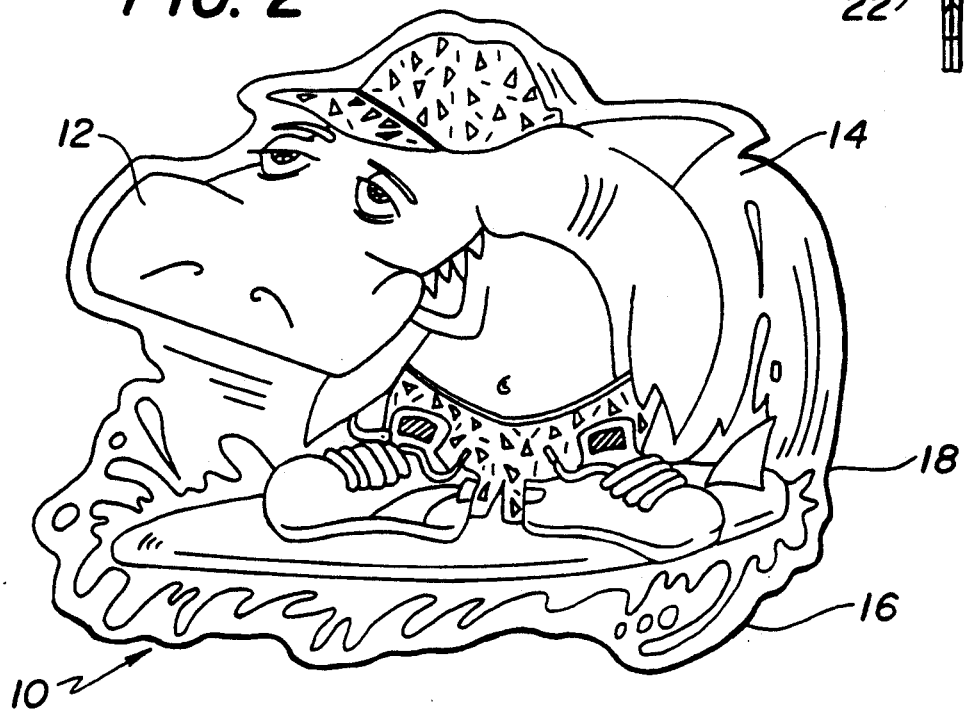
FIG. 2 is the front view of another toy of the present invention showing the package having a different silhouette and visual image of a different fantasy character riding a surfboard.

The toy 10 comprises a package 14 having an outer peripheral edge 16 forming a silhouette 18 generally conforming in shape to an object, such as the imaginary cartoon-like characters shown in FIGS. 1 and 2. The package preferably includes a visual image or presentation of that object on the exterior of the package and may appear on either the front or rear or both sides of the package. The silhouette formed by the outer peripheral edge, as well as the visual presentation of that silhouette, can take on many different forms, e.g., a person, animal, fish, whether cartoon-like or accurate in representation, article of manufacture, and may further include fictional inanimate and animate objects, etc., or any combination thereof.

In FIG. 1 for example, is shown the image 12 of a human-like caricature of a shark holding a guitar, while in FIG. 2 is shown a similar caricature of a hammerhead shark on a surfboard. As shown in FIGS. 1 and 2, the silhouette 18 of the character and/or object generally conforms to the image depicted on the exterior of the package. This is one important and desirable feature of the present invention, since it provides entertainment value apart from any articles contained in the package.

It is also preferable that the package be of a sufficient size to be grasped in the hand of a person using the package, to enable the person using the toy to play with it.

Figure 3:
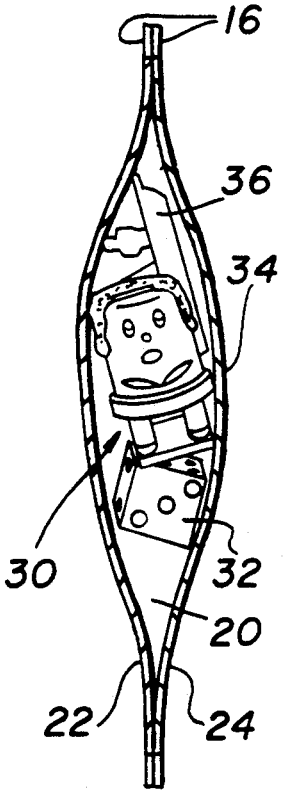
FIG. 3 is a cross sectional view of the toy of Figure 1, taken along line 3—3, showing the inner compartment holding a plurality of novelty items therein.

As shown in FIG. 3, the package has an inner compartment 20 to hold at least one novelty item 30 therein, such as the die 32, character 34 and/or boat 36. As should be readily apparent to those skilled in the art, depending upon the size of the inner compartment 20, that the number and type of novelty items which may be contained therein may be varied in accordance with various uses and considerations. In fact, in the preferred form of the invention, multiple novelty items are included within the compartment 20; three being shown in FIG. 3. Other novelty items which are suitable for use with the present invention include those shown in FIG. 4, such as the miniature rifle 40, key chain with emblem 42 and toy spaceship 44, as well as many other novelty items, such as sewing kits, miniature scissors and other small, useful articles.

The package is preferably comprised of at least two sheets 22 and 24, made of generally opaque, water dispersable material, each of which has a peripheral edge 16 which forms the silhouette. The package may be formed by securing the peripheral edges 16 of the two sheets together with a water soluble (e.g., starch binder). Although any water dispersable (e.g., dissolvable) material may be utilized, it is preferable that the package be comprised, of the DISSOLVO material heretofore identified. It is also preferable that the material used give the appearance of dissolving, disappearing or disintegrating in the water, as opposed to merely separating sufficiently to permit the novelty item(s) to be exposed. In addition, it is desirable, and in fact important in the most preferred embodiment of the invention, that the material used to manufacture the package be sufficiently opaque that the user cannot see what is inside the inner compartment; thereby maintaining the element of surprise. The opaqueness of the package may be further augmented by including a visual presentation or depiction on either or both sides of the package.

Although the novelty item to be contained within the inner compartment may be of almost any shape, it is preferable that the novelty item have a predetermined and/or preformed shape which is different than the silhouette of the package, to further add to the surprise element of the toy. In addition, it is desirable that the novelty item have entertainment value independent of any other object, e.g., the novelty item has entertainment value, even when utilized without interaction or function in relation to any other object besides the user. Even a novelty item in the form of a toy key chain has independent entertainment value to a child, apart from its use with a key.

It is desirable that the novelty item maintain its predetermined or preformed shape when exposed to the water and such items are therefore preferably comprised of a material which does not deform, compress, expand or otherwise change in appearance or shape, when handled normally by a user or when exposed to water to dissolve the outer sheets 22 and 24. Representative materials are plastics, metals, rubbers, etc.

When the child or other user is first presented with the toy, that person may enjoy the image presented on the exterior of the package and play with the toy as desired. Thereafter, as shown in FIG. 5, the user may place the toy 10 into a container 50 holding water 52 therein. The package 14 will then dissolve to reveal the novelty item(s) 32, 34, 36 contained therein. The rate at which the package dissolves will depend upon the material of which it is comprised and is aided by stirring or shaking the water in which it is placed (e.g., when the water is in a hand-held container, such as a bowl or jar). Shaking tends to prevent the user from observing the pouch dissolve; thereby giving the illusion or appearance that the package has disappeared. In one representative embodiment of the present invention, the outer package will dissolve in less than one minute.

Without further elaboration the foregoing will so fully illustrate my invention that others may, by applying current or future knowledge, adopt the same for use under various conditions of service.

I claim:

1. A self-contained and independently usable toy combination whose entertainment value is altered when a portion of the toy is immersed in water, the toy combination comprising:

(a) a package having an outer periphery forming a silhouette generally conforming in shape to an object, the package having an inner compartment to hold at least one novelty item therein, the package being comprised of a pair of flexible sheets of water dispersable material, said pair of sheets being of sufficient opacity to visually mask the identity of the at least one novelty item, said inner compartment including inwardly facing surfaces of said pair of flexible sheets, said pair of sheets being secured together to completely enclose the inner compartment from visual inspection; and (b) the at least one novelty item having a preformed, non-expanding shape and size which is the same both inside and outside of the package and when exposed and unexposed to water, said non-expanding shape and size being different than the silhouette of the package, said at least one novelty item being contained solely by and entirely within the inner compartment of said package, with the flexible sheets of said package being flexed into a configuration for accommodating the at least one novelty item in said inner compartment without generally conforming to the entire peripheral shape of said at least one novelty item, said at least one novelty item having entertainment value independent of the package silhouette.

2. The toy combination of claim 1 wherein the package has a front and rear surface terminating in an outer peripheral edge which defines the silhouette and at least one of the front and rear surfaces ha a visual presentation thereon of the object generally defined by the silhouette.

3. The toy combination of claim 2 wherein the two sheets are secured together in the region adjacent the outer peripheral edge with a binder to provide the inner compartment.

4. The toy combination of claim 3 wherein the binder is a water soluble binder.

5. The toy combination of claim 2 wherein the shape of the object is selected from the group consisting of an generally accurate or generally caricature-like representation of an animal, a fish, a person, a fantasy character, a monster, and an article of manufacture.

6. The toy combination of claim 2 wherein multiple novelty items are contained within the inner compartment.

7. The toy combination of claim 6 wherein the multiple novelty items are designed for use independent from the package.

8. The toy combination of claim 1 wherein the package has a front and rear surface terminating in the silhouette and each of the front and rear surfaces has a visual presentation thereon of the object generally defined by the silhouette.

9. The toy combination of claim 1 wherein the shape of the identifiable object is selected from the group consisting of an generally accurate or generally caricature-like representation of an animal, a fish, a person, a fantasy character, a monster, and an article of manufacture.

10. The toy combination of claim 1 wherein multiple novelty items are contained within the inner compartment.

11. The toy combination of claim 10 wherein the multiple novelty items are designed for sue independent from the package.

12. The toy combination of claim 1 wherein all the components of the at least two sheets are dispersable in water.

13. The toy combination of claim 1 wherein the package dissolves in less than one minute when immersed in water.

14. A self-contained and independently usable toy combination including a package and at least one novelty item therein, said package including an interior compartment and being dissolvable in water, the package being sufficiently opaque to preclude visual inspection of any article disposed within the interior compartment, said at least one novelty item being of a preformed, non-expandable shape and size, said shape and size being the same both in and out of the package and both in and out of the presence of water, said at least one novelty item being contained solely by and entirely within the interior compartment of said package and having independent entertainment value, the package including a pair of flexible sheets secured together to completely close the interior compartment to preclude viewing of the at least one novelty item therein and to generally define the shape of an animate or inanimate object of character, said sheets of said package being sufficiently flexible to conform to a configuration for accommodating said at least one novelty item within the interior compartment without generally conforming to the entire peripheral shape of said at least one novelty item.

15. The toy combination of claim 14 wherein the package includes a surface terminating in the outer peripheral edge, the surface including a visual presentation of the animate or inanimate object or character generally defined by the peripheral edge.

16. The toy combination of claim 14 wherein the package includes opposed walls adhered together in a region adjacent the outer peripheral edge to provide the inner, sealed compartment, the opposed walls each including an outwardly facing surface terminating in the outer peripheral edge, each of the surfaces including a visual presentation of the animate or inanimate object or character generally defined by the peripheral edge.

17. The toy combination of claim 14 wherein the outer peripheral edge generally defines the shape of an animal-like or fish-like object.

18. The toy combination of claim 17 wherein the animal-like or fish-like object is a fictitious representation.

19. The toy combination of claim 14 wherein more than one non-expandable novelty item of a preformed shape and size which is the same both in and out of the package and both in and out of the presence of water is disposed within the sealed compartment.

20. The toy combination of claim 19 wherein all of the novelty items are designed for use independent from any article outside of the compartment.

21. The toy combination of claim 14 wherein the package dissolves in less than one minute when immersed in water.

* * * * *